United States Patent [19]

Seidler

[11] Patent Number: 4,498,490

[45] Date of Patent: Feb. 12, 1985

[54] ADJUSTABLE PRODUCT APPLICATOR

[75] Inventor: David Seidler, Forest Hills, N.Y.

[73] Assignee: Max Factor & Co., Hollywood, Calif.

[21] Appl. No.: 401,068

[22] Filed: Jul. 23, 1982

[51] Int. Cl.[3] ..... A45D 40/30

[52] U.S. Cl. ..... 132/88.5

[58] Field of Search ..... 132/88.5, 88.7; 401/122, 129, 127, 170, 128

[56] References Cited

U.S. PATENT DOCUMENTS

| | | | |
|---|---|---|---|
| Re. 21,757 | 4/1941 | Deakers et al. | 401/128 |
| 2,602,425 | 7/1952 | Wing | 401/170 X |
| 3,662,769 | 5/1972 | Vasas | 401/122 |
| 3,768,915 | 10/1973 | Spatz | 401/127 |
| 3,998,235 | 12/1976 | Kingsford | 132/88.7 |

*Primary Examiner*—Gregory E. McNeill

*Attorney, Agent, or Firm*—Pretty, Schroeder, Brueggemann & Clark

[57] ABSTRACT

A product applicator which is adjustable to vary the amount of product retained by the applicator for subsequent application and to vary the combing effect thereof. The applicator includes a stem and an applicator head coupled to the stem. A platform is in fluid communication with the applicator head. An adjusting mechanism selectively adjusts the distance between the applicator head and the platform.

7 Claims, 10 Drawing Figures

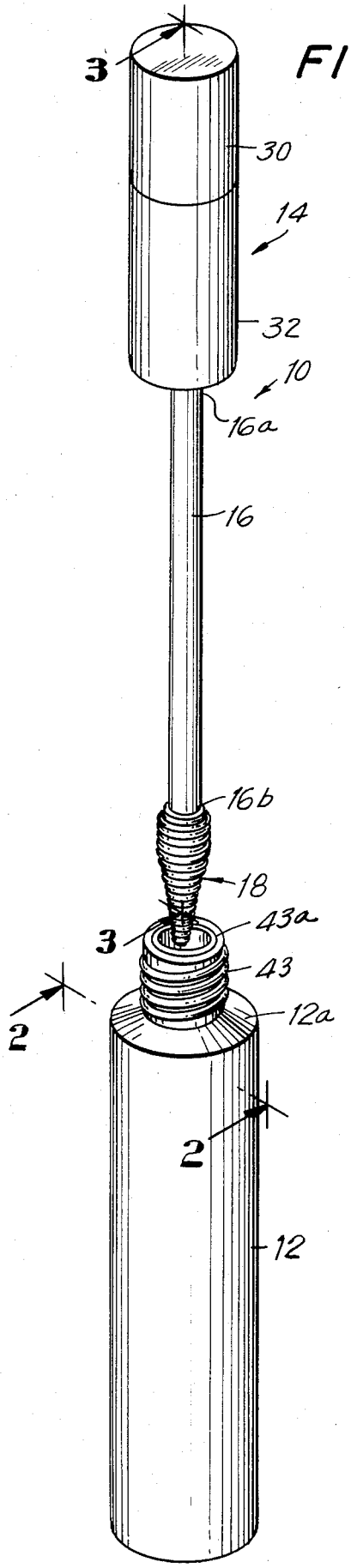
FIG. 1
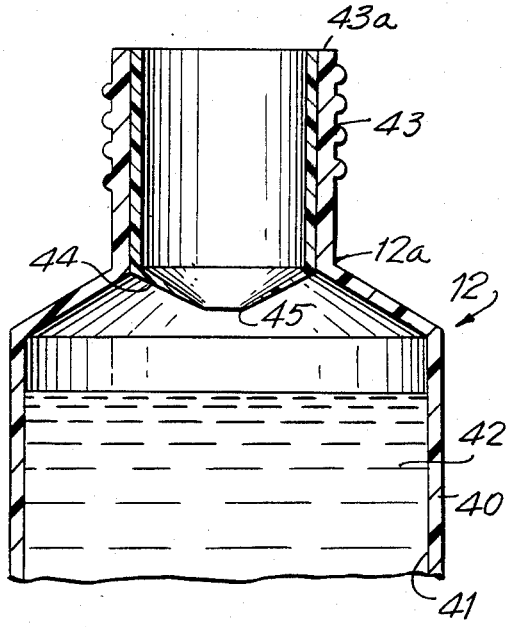
FIG. 2
FIG. 5
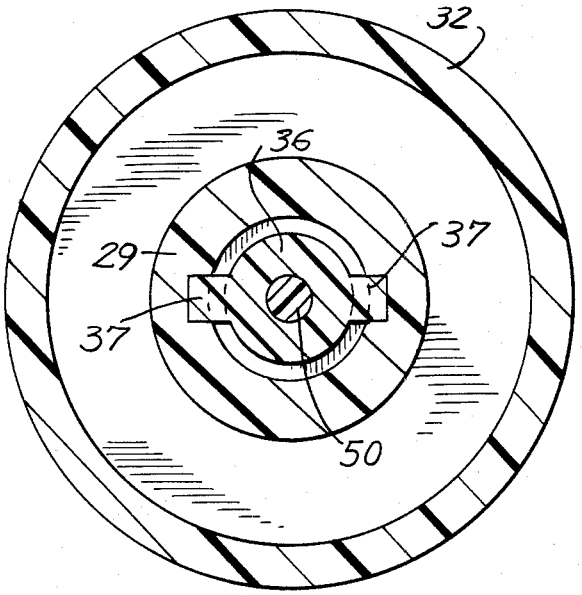

ADJUSTABLE PRODUCT APPLICATOR

BACKGROUND OF THE INVENTION

This invention is directed to a product applicator and, in particular, to an adjustable product applicator particularly suited for use in applying varying amounts of a cosmetic product, such as mascara, to the lashes of a user.

Conventional product applicators of the type under discussion, such as mascara applicators, generally include an elongated stem having a handle secured to a first end thereof. The handle is utilized to hold the applicator when applying the product and also acts as a cap for the container in which the product to be applied is stored. An applicator head such as a brush or the like is attached to the opposite end of the stem and is used for applying the product in the container to the lashes.

During storage, the stem and brush are situated in the container with the handle-cap removably secured to the top of the container. When the cap is removed from the container, the applicator head is withdrawn and will hold an amount of product to be applied. In such conventional product applicators, the amount of product, such as mascara, retained by the applicator head cannot be varied due to the fixed, unadjustable construction of the applicator head.

In order to allow for predetermined, metered amounts of mascara to be applied by the applicator head, it has been proposed to provide an applicator device having an applicator head with a plurality of coating surfaces wherein the spacing between adjacent coating surfaces is selectively variable such as is shown in U.S. Pat. No. 3,998,235. In adjustable mascara applicators of the type described in U.S. Pat. No. 3,998,235, the axial distance between coating surfaces on the applicator head is adjustable for application of a desired amount of mascara to the lashes of a user. However, it would be desirable to have an adjustable mascara applicator wherein the axial spacing between coating surfaces is fixed in order to prevent the possibility of the user's lashes getting caught therebetween while providing adjustability to allow for application of a desired amount of mascara and to control the combing and separating action of the applicator head.

Accordingly, it is desired to provide a product applicator particularly suited for use in applying mascara to the lashes of a user which is adjustable to control the amount of mascara that is deposited on the lashes and for controlling the degree of combing and separating action.

SUMMARY OF THE INVENTION

Generally speaking, in accordance with the present invention, an adjustable product applicator particularly suited for use in applying mascara to the lashes of a user, is provided. The applicator includes a stem having an applicator head coupled thereto. A platform is provided in fluid communication with the applicator head. The distance between the platform and the applicator head is selectively adjustable by the user so that varying amounts of the product can be carried by the applicator for subsequent application.

In a preferred embodiment, the stem is elongated and includes first and second ends. A handle, in the form of a container cap, is coupled to the first end of the stem. The applicator head is coupled to the second end of the stem and includes a plurality of coating surfaces fixedly spaced apart by a predetermined amount. The coating surfaces define a hollow interior and the platform is situated in the hollow interior of the applicator head. The platform is coupled to the handle through the stem. The handle is used to adjust the radial spacing between the platform and the coating surfaces to provide the desired degree of adjustability.

Accordingly, it is an object of the instant invention to provide an improved adjustable product applicator.

Another object of the instant invention is to provide an improved adjustable product applicator having spaced application surfaces having a fixed relationship.

Still another object of the instant invention is to provide an improved adjustable mascara applicator.

Yet another object of the instant invention is to provide an adjustable mascara applicator wherein the distance between the coating surfaces on the applicator head and a platform situated therein is adjustable for controlling the amount of mascara to be deposited and for controlling the degree of combing and separating of the lashes.

A further object of the instant invention is to provide a mascara bottle with an improved adjustable applicator.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of an adjustable product applicator constructed in accordance with a preferred embodiment of the present invention, with the applicator shown removed from the product container;

FIG. 2 is an enlarged partial sectional view taken along line 2—2 of FIG. 1;

FIG. 5 is an enlarged sectional view taken along line 5—5 of FIG. 3;

DESCRIPTION OF THE PREFERRED EMBODIMENTS

Figure 3:
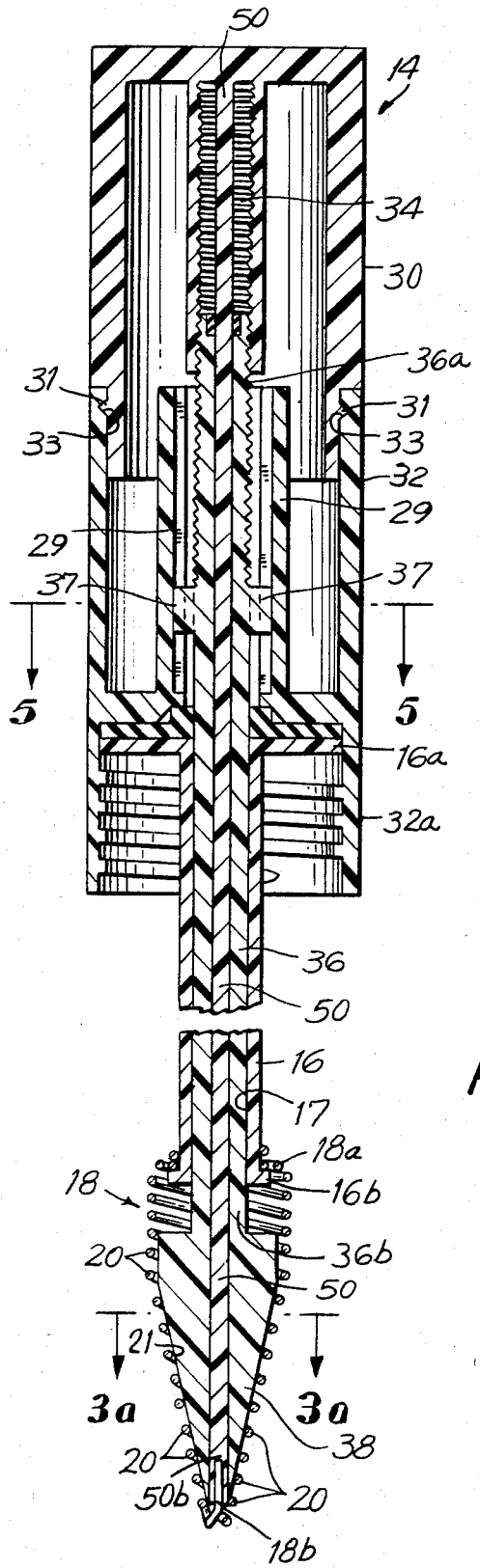
FIG. 3 is an enlarged fragmentary sectional view taken along line 3—3 of FIG. 1.
Figure 3A:
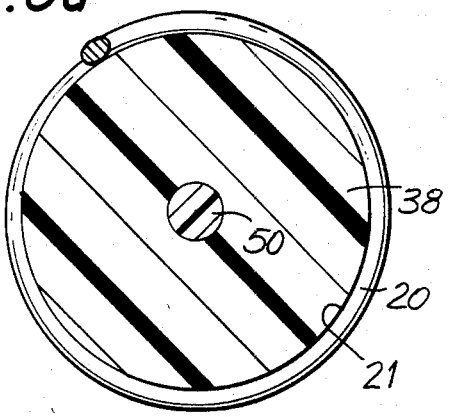
FIG. 3A is an enlarged sectional view taken along line **3*a*—3*a* of FIG. 3**.

Reference is first made to FIG. 1 wherein an adjustable product applicator, generally indicated at 10, and constructed in accordance with a preferred embodiment of the present invention is shown removed from its associated product container or bottle 12. Product applicator 10 includes a handle generally indicated at 14 having an elongated stem 16 extending therefrom. Handle 14 is secured to a first end 16*a* of stem 16 in a manner to be fully described below. The second end 16*b* of shaft 16 includes an applicator head generally indicated at 18.

Referring now to FIG. 2 in addition to FIG. 1, product container 12 includes an outer wall 40 which defines an inner chamber 41 for storage of a product 42, such as mascara, to be applied by applicator 10. The top 12*a* of product container 12 includes a threaded neck 43 to which handle 14 can be removably secured so that handle 14 acts as the cap for container 12. A flexible wiper 44 having a central opening 45 is positioned within neck 42 and is provided for wiping product 42 off of stem 16 and excess product 42 off of applicator head 18 as applicator 10 is removed from product container 12.

Figure 4A:
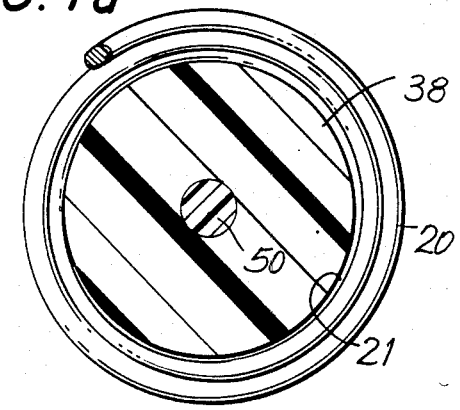
FIG. 4A is an enlarged sectional view taken along line **4*a*—4*a* of FIG. 4**.
Figure 4:
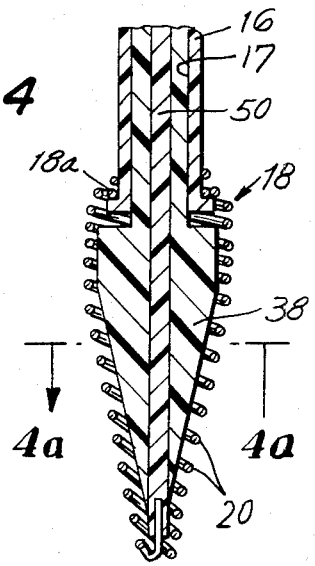
FIG. 4 is a partial sectional elevational view of the applicator head depicted in FIG. 3 with the platform shown in a retracted position.

Referring additionally to FIGS. 3 through 5, it can be seen that applicator head 18 is a cone-shaped spiral wound structure defining a plurality of coating surfaces 20 which are preferably fixedly spaced apart by a predetermined amount. Handle 14 is a two part structure having an upper portion 30 which is rotatably supported on a lower portion 32. In this regard, upper portion 30 includes a tongue 31 which is received in a groove 33 formed in lower portion 32 which allows for relative rotation therebetween. Lower portion 32 of handle 14 is internally threaded at the lower end 32*a* thereof for mating engagement with threaded neck 43 of bottle 12 so that handle 14 can be releasably secured to container 12 with stem 16 and applicator head 18 situated within chamber 41.

Stem 16 includes a central longitudinal aperture 17 and a first end 16*a* which is secured in lower portion 32 of handle 14. First end 16*a* acts as a seal against the lip 43*a* of neck 43 when handle 14 is secured to bottle 12. The upper end 18*a* of applicator head 18 is attached to the second end 16*b* of stem 16. A hollow rod 36 is slidably supported within central aperture 17 of stem 16. Rod 36 includes a first threaded end 36*a* which is matingly engaged with corresponding threads 34 formed in upper portion 30 of handle 14. The second end 36*b* of rod 36 includes a cone-shaped platform 38 which is situated within the cone-shaped hollow interior 21 defined by coating surfaces 20 of applicator head 18 and is therefore in fluid communication therewith.

A shaft 50 secured at first end 50*a* thereof to upper portion 30 extends through hollow rod 36 into platform 38. The second end 18*b* of applicator head 18 is coupled to second end 50*b* of shaft 50. Thus, applicator head 18 is captured between end 16*b* of stem 16 and second end 50*b* of shaft 50 thereby insuring that the spacing between coating surfaces 20 remain a fixed distance apart.

In accordance with the above discussion, the desired degree of adjustability is provided by extending or retracting platform 38 within opening 21. By rotating upper portion 30 of handle 14 with respect to lower portion 32 thereof, rod 36 will be longitudinally displaced in order to selectively position platform 38 with respect to coating surfaces 20. Since both coating surfaces 20 and platform 38 are correspondingly cone-shaped, selective longitudinal displacement of platform 38 with respect to coating surfaces 20 will selectively vary the distance between platform 38 and coating surfaces 20 to provide the desired degree of adjustability. In order to provide proper longitudinal displacement of platform 38, rod 36 includes an enlarged portion 37 which is sized to ride along inner wall 29 of lower portion 32.

As depicted in FIG. 3, platform 38 is in its fully extended position and coating surfaces 20 essentially contact platform 38. As upper portion 30 is rotated with respect to lower portion 32, platform 38 will be retracted from the position depicted in FIG. 3 and will define a space between platform 38 and coating surfaces 20 as shown in FIG. 4. When platform 38 is at the fully extended position depicted in FIG. 3, a minimum amount of product will be deposited on applicator head 18 when applicator head 18 is withdrawn through wiper 44 in the neck 43 of bottle 12. When platform 38 is in a fully withdrawn position, a maximum amount of product will be deposited thereon. Accordingly, an adjustable product applicator is provided wherein the axial spacing between adjacent coating surfaces 20 remains fixed. The adjustable platform provides the desired degree of adjustability so that a user can set the applicator to apply the desired amount of product. When platform 38 is at its fully extended position as depicted in FIG. 3, due to the closeness of coating surfaces 20 to platform 38, a minimum combing and separating effect is achieved. When platform 38 is retracted as depicted in FIG. 4, a greater combing and separating effect is achieved since a gap is defined between platform 38 and coating surfaces 20.

In addition to the above adjustments, various combinations of effects can be obtained with the present invention. By withdrawing applicator head 18 from container 12 while platform 38 is in its fully extended position and then retracting platform 38 by a desired amount, a small amount of product can be deposited on the lashes with a greater combing effect. Conversely, by withdrawing applicator head 18 from container 12 when platform 38 is in a retracted position and then moving platform 38 to its fully extended position, a greater deposit of product will be found on applicator head 18 with a minimum combing effect on the hair. Between these two extreme positions, a plurality of combinations are possible depending upon the particular requirements of a user. In order to adapt to various types of products to be applied by applicator 10, platform 38 can be constructed from different types of materials. Instead of the rigid structure depicted, platform 38 may include a soft foam layer which would absorb a more flowable product than the pasty, semi-solid substance generally utilized for mascara.

Figure 6:
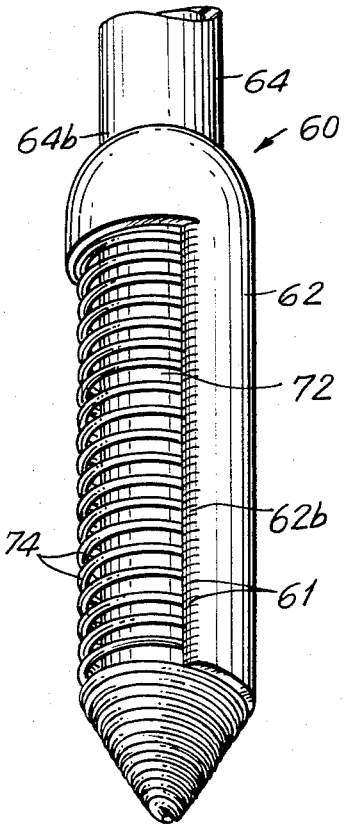
FIG. 6 is an elevational view of an applicator head constructed in accordance with an alternate embodiment of the present invention.
Figure 7:
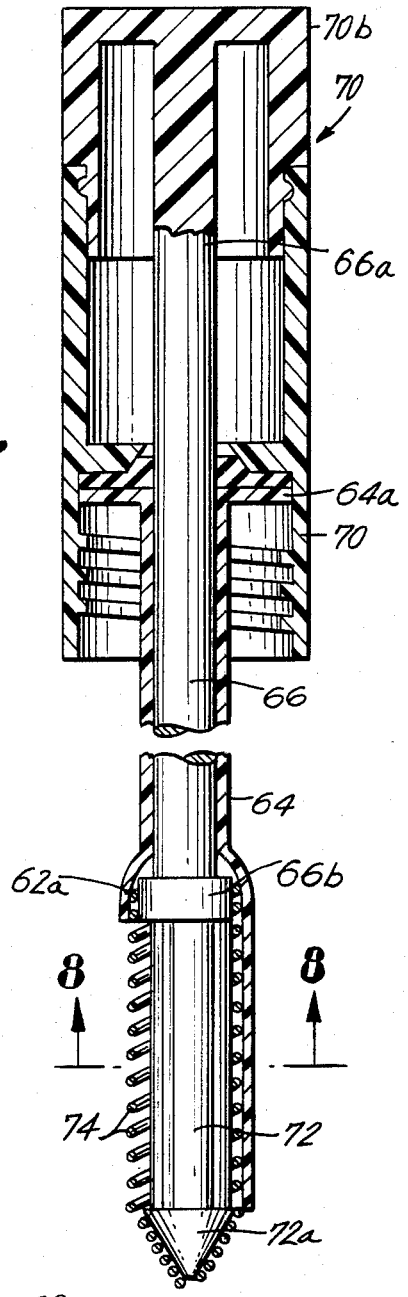
FIG. 7 is a fragmentary sectional elevational view of an alternative embodiment of the adjustable product applicator of the present invention utilizing the applicator head depicted in FIG. 6.
Figure 8:
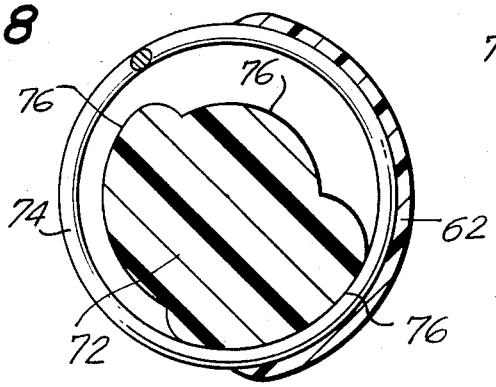
FIG. 8 is an enlarged sectional view taken along line 8—8 of FIG. 7.

Referring now to FIGS. 6 through 8, an alternate embodiment of the adjustable product applicator of the present invention will be described. In the embodiment depicted, an applicator head 60 includes a C-shaped casing 62 which extends from the second end 64*b* of a stem 64. Stem 64 includes a first end 64*a* which is secured in the lower portion 70*a* of handle 70. Handle 70 also includes an upper portion 70*b* which is rotatably supported on lower portion 70*a* by a tongue and groove arrangement. Stem 64 is hollow to allow for a rod 66 to extend therethrough and to be rotatably supported within stem 64.

A first end 66*a* of rod 66 is secured to upper section 70*b* of handle 70. Rod 66 terminates in a second end 66*b* which defines a platform 72. Platform 72 is situated within coils 74 of applicator head 60 which are the coating surfaces. Coils 74 are fixed between cone-shaped end 72*a* of platform 72 and the upper end 62*a* of casing 62. Accordingly, the axial spacing between adjacent coils 74 remains substantially fixed and unvarying.

Platform 72 includes several arcuate surfaces 76 which define different radial spacings from the central axis defined by rod 66. As upper section 70*b* of cap 70 is rotated with respect to lower section 70*a*, different arcuate surfaces will be brought into alignment with the exposed coils 74 to thereby define a given spacing therebetween. Accordingly, the distance between platform 72 and coils 74 can be varied by rotating a given arcuate surface 76 into facing arrangement with exposed coils 74 of applicator head 60. Thus, this construction provides the same effect as that described above with respect to FIGS. 1 through 5. It is noted that C-shaped casing 62 may include serrations 61 along the edges 62*b* thereof in order to further enhance the combing effect and product application to the hair or eyelashes of a user.

The present invention provides an adjustable product applicator wherein the spacing between the platform and coating surfaces can be selectively varied in order to achieve the desired effects. It is noted that the applicator head may be of other constructions such as providing bristles on the coating surfaces to enhance the application of a product. It is also recognized that other mechanisms may be utilized to vary the distance between the platform and the coating surfaces.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A product applicator comprising:

a stem;

an applicator head coupled to said stem and including a plurality of coating surfaces defining an opening;

a platform within the opening, in fluid communication with said applicator head, said platform including at least two arcuate surfaces having different radii; and handle means including first and second portions rotatably coupled together, said stem being coupled to said first portion and said platform being coupled to said second portion, with rotation of said second portion relative to said first portion rotating said platform to bring a selected arcuate surface of said platform into alignment with said coating surfaces.

2. The product applicator as defined in claim 1, wherein said applicator head includes a casing in which said coating surfaces are supported, said casing including an edge extending longitudinally along said coating surfaces and having a plurality of serrations.

3. The product applicator as claimed in claim 1, wherein said stem is hollow and includes first and second ends, the first end of said stem being supported in said first portion and the second end of said stem supporting said coating surfaces, a rod extending through said hollow portion of said stem secured at one end thereof to said second portion and at the other end thereof secured to said platform.

4. The product applicator as claimed in claim 2, wherein said stem is hollow and includes first and second ends, the first end of said stem being supported in said first portion and the second end of said stem supporting said coating surfaces, a rod extending through said hollow portion of said stem secured at one end thereof to said second portion and at the other end thereof secured to said platform.

5. The product applicator as claimed in claim 14, wherein said casing is secured to said second end of said stem.

6. A mascara applicator comprising an elongated stem having first and second ends, a handle means coupled to said first end of said stem, an applicator head coupled to said second end of said stem, said applicator head having a plurality of spaced coating surfaces, said coating surfaces defining a hollow interior, a platform positioned within said hollow interior and including at least two arcuate surfaces having different radii, and adjusting means for rotating said platform within the hollow interior to position a selected one of the arcuate surfaces of said platform proximate said coating surfaces.

7. A mascara applicator comprising:

an elongated stem having a first end and a second end;

handle means coupled to the first end of said stem;

an applicator head coupled to the second end of said stem, said applicator head having a plurality of spaced coating surfaces defining a hollow interior; and a platform positioned within the hollow interior, said platform and said coating surfaces being correspondingly cone-shaped;

said handle means including first and second members rotatably coupled together, said stem being coupled to said first member and said platform being coupled to said second member, with rotation of said first member relative to said second member causing longitudinal displacement of said platform, to vary the distance between said platform and said coating surfaces.

* * * * *